United States Patent [19]

Fazzolari et al.

[11] Patent Number: 4,690,441

[45] Date of Patent: Sep. 1, 1987

[54] SHROUDED SLIDE LOCK ASSEMBLY

[75] Inventors: Anthony Fazzolari; Nicholas Fazzolari, both of Brooklyn, N.Y.

[73] Assignee: Myron Siegel, Brooklyn, N.Y.

[21] Appl. No.: 779,482

[22] Filed: Sep. 25, 1985

[51] Int. Cl.[4] ..... E05C 5/02

[52] U.S. Cl. ..... 292/57; 70/128; 70/417

[58] Field of Search ..... 70/130, 417, 129, 134, 70/118, 128, 54, 5 L; 292/57, 58, 148, 346, 150

[56] References Cited

U.S. PATENT DOCUMENTS 1,359,347 11/1920 Fleisher ..... 292/346

4,437,692 3/1984 Halopoff ..... 292/57

FOREIGN PATENT DOCUMENTS 1135192 12/1968 United Kingdom ..... 70/417

*Primary Examiner*—Robert L. Wolfe

*Attorney, Agent, or Firm*—Richard L. Miller

[57] ABSTRACT

A vandal resistant shrouded slide bolt lock assembly is provided and consists of a shroud guide and a staple secured to a plate that is secured near and edge of a door. A bracket is secured to a wall frame so that when the door is closed an end portion of the shroud guide will cover the bracket allowing a slide bolt to manually enter the bracket and an aperture in the end portion of the shroud guide while a hasp will contact with the staple. A bushing rotatively mounted on said slide bolt between said shroud guide and said hasp to prevent tampering and cutting of said bushing and said slide bolt therein.

4 Claims, 4 Drawing Figures

SHROUDED SLIDE LOCK ASSEMBLY

BACKGROUND OF THE INVENTION

This application is a substitute application for Ser. No. 06/520,295, filed Aug. 3, 1983, which is now abandoned for lack of prosecution. The drawings from the parent application are to be transferred into this application. The text which follows this sentence is believed to be identical to that filed in the original above identified parent application.

The instant invention relates generally to locks and more specifically it relates to a shrouded slide bolt lock assembly.

Numerous locks have been provided in prior art that are adapted to use a slide bolt to lock a door. For example, U.S. Pat. Nos. 215,503; 777,135; and 798,583 all are illustrative of such prior art. While these units may be suitable for the particular purpose to which they address, they would not be as suitable for the purposes of the present invention as heretofore described.

SUMMARY OF THE INVENTION

A principle object of the present invention is to provide a shrouded slide bolt lock assembly that will prevent opening of a door away from a wall frame.

Another object is to provide a shrouded slide bolt lock assembly that is vandal resistant.

An additional object is to provide a shrouded slide bolt lock assembly that is safe, strong and of durable construction.

A further object is to provide a shrouded slide bolt lock assembly that is simple and easy to use.

A still further object is to provide a shrouded slide bolt lock assembly that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figure 1:
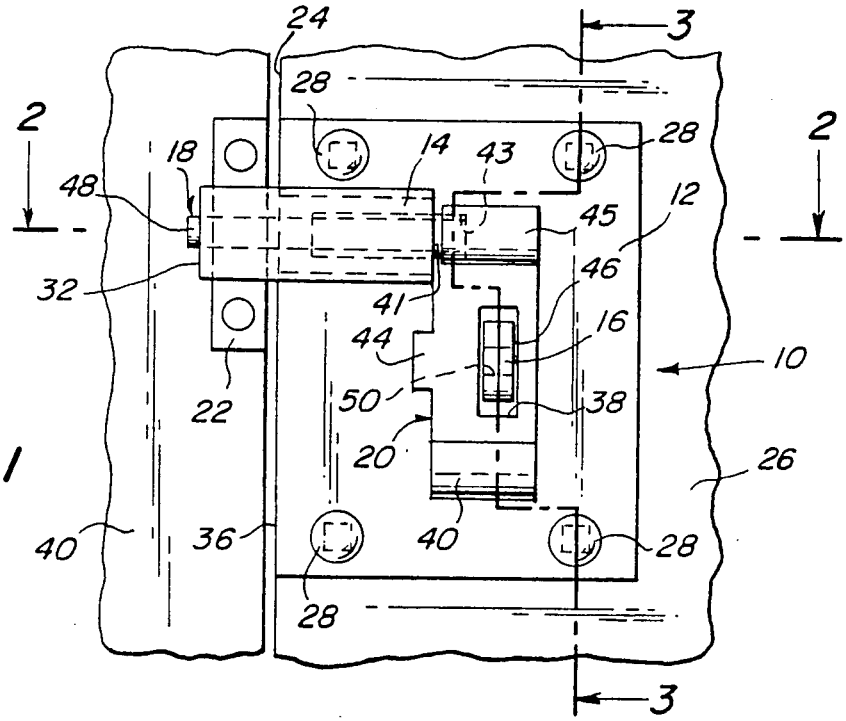
FIG. 1 is a front elevational view of the invention mounted on a door and wall frame.
Figure 2:
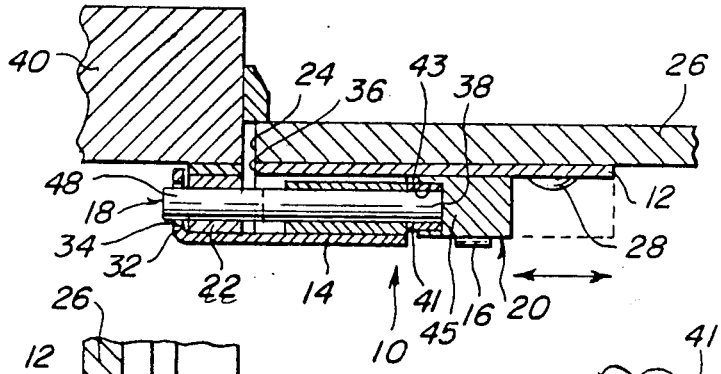
FIG. 2 is a horizontal cross sectional view taken along line 2—2 in FIG. 1.
Figure 3:
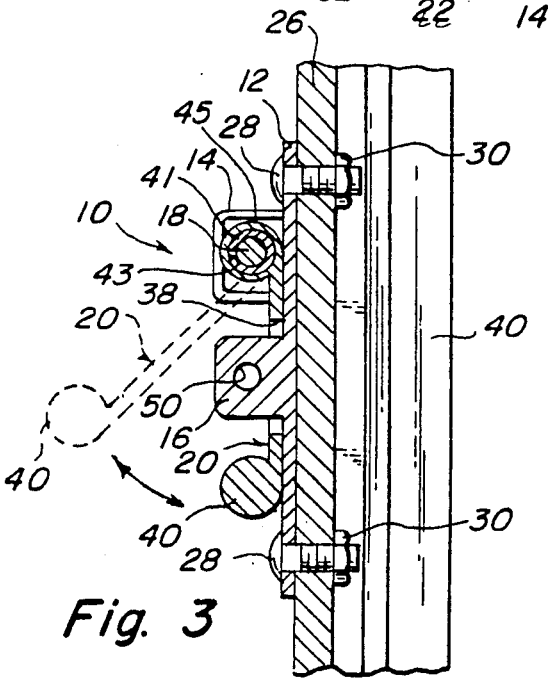
FIG. 3 is a vertical cross sectional view taken along line 3—3 in FIG. 1.
Figure 4:
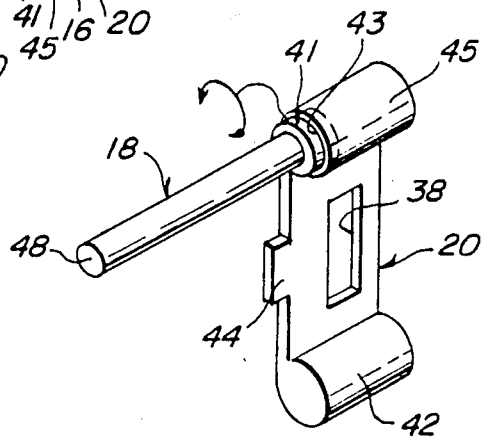
FIG. 4 is a perspective view of the slide bolt illustrating the anti-cutting roller feature of the bolt.

Turning now descriptively to the drawings, in which similar reference characters denote similar elements throughout the several views, FIGS. 1 through 4 illustrates a shrouded slide bolt lock assembly 10 that consists of a plate 12, a shrouded guide 14, a staple 16, a slide bolt 18, a hasp 20 and a bracket 22.

The plate 12 is secured near edge 24 of a door 26 in any suitable manner, such as by four carriage bolts 28 and nuts 30 mounted at each corner. The shroud guide 14 is secured to the plate 12 with an end portion 32 having an aperture 34 projecting over end 36 of the plate 12. The staple 16 is secured to the plate 12. The slide bolt 18 is mounted in the shroud guide 14 in such a manner as to permit sliding endwise and rotary movement therein. The hasp 20 has a slot 38 therein and is secured at a right angle to one end of the slide bolt 18. The bracket 22 is secured to a wall frame 40 in any suitable manner.

When the door 26 is closed the end portion 32 of the shroud guide 14 will cover the bracket 22 allowing the slide bolt 18 to manually enter the bracket 22 and the aperture 34 in the end portion 32 of the shroud guide 14 while the slot 38 in the hasp 20 will coact with the staple 16.

The shrouded slide bolt lock assembly further contains a bushing 41 rotatively mounted on the slide bolt 18 between the shroud guide 14 and the hasp 20 to prevent tampering and cutting of the bushing 40 and the slide bolt 18 therein. The bushing 40 is fitted into an annular groove 43 in the top portion 45 to further protect the slide bolt 18.

The hasp 20 further contains a weighted end portion 42 so that the hasp 20 will normally stay in a vertical position against the plate 12. The weighted end portion 42 can be used as a finger grip to raise the hasp 20 when so needed. A tab 44 is secured to the side 46 of the hasp 20 that faces the edge 24 of the door 26. When the hasp 20 is raised up away from the staple 26 and the slide bolt 18 removed from the bracket 22 the tab 44 will engage side 46 of the staple 16 when the hasp 20 is lowered against the plate 12. The tab 44 prevents end 48 of the slide bolt 18 from slipping forward to reenter the bracket 22 so that the door 26 can not become inadvertently locked, when unlocked.

In the shrouded slide bolt lock assembly 10 the plate 12, shroud guide 14, staple 16, slide bolt 18, hasp 16, bracket 22 and bushing 41 are fabricated from hardened steel.

In operative use to lock the door 26 the hasp 20 is lifted up and pushed towards the shroud guide 14 until the slide bolt 18 enters the bracket 22 and aperture 34 of the end portion 32. The hasp 20 is then lowered until the slot 38 coacts with the staple 16. A pad lock (not shown) can then be applied to the eye 50 of staple 16 to secure the slide bolt 18 against movement. If a vandal tried to cut the slide bolt 18 away from the hasp 20 the bushing 41 will turn making it very difficult and vandal resistant.

Conversely to unlock the door 26 the padlock is removed from the staple 16 and the hasp 20 is lifted up and pulled away from the shroud guide 14 until the slide bolt 18 disengages the bracket 22 and the aperture 34 of the end portion 32. The hasp 20 is then lowered against the plate 12 with tab 44 against the side 46 of the staple 16. The door 26 can then be opened.

It is to be further appreciated that this is an exceedingly difficult lock to burglarize because of the shroud 32, and bushing 41, which prevent the bolt from being easily cut.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A shrouded slide bolt lock assembly which comprises:

(a) a plate to be secured near the edge of a door;

(b) an exposed shroud guide directly secured to and projecting from said plate with an end portion having an aperture projecting over an edge of said plate;

(c) a staple secured to said plate;

(d) a slide bolt mounted in said shroud guide having endwise and rotatory movement therein;

(e) a hasp secured at right angle to one end of said slide bolt;

(f) a bracket secured to a wall frame so that when the door is closed the end portion of said exposed shroud guide will cover said bracket allowing said slide bolt to manually enter said bracket and aperture in the end portion of said shroud while said hasp will coact with said staple, and (g) a bushing rotatively mounted on said slide bolt between said exposed shroud guide and said hasp to prevent tampering and cutting of said bushing and said slide bolt therein.

2. A shrouded slide bolt lock assembly as recited in claim 1 wherein said hasp further comprises a weighted end portion so that said hasp will normally stay in a vertical position against said plate and said weighted end portion can be used as a finger grip to raise said hasp when so needed.

3. A shrouded slide bolt lock assembly as recited in claim 2 wherein said hasp further comprises a tab secured to side facing the edge of the door so that when said hasp is raised up away from said staple and said slide bolt removed from said bracket said tab will engage side of said staple when said hasp is lowered against said plate to prevent end of said slide bolt from slipping forward to reenter said bracket preventing the door from becoming inadvertently locked.

4. A shrouded slide bolt lock assembly as recited in claim 3 wherein said plate, shroud, guide staple, slide bolt, hasp, bracket and bushing are fabricated from hardened steel.

* * * * *